US010655418B2

(12) United States Patent
Rytlewski

(10) Patent No.: US 10,655,418 B2
(45) Date of Patent: May 19, 2020

(54) SUBSEA LANDING STRING WITH AUTONOMOUS EMERGENCY SHUT-IN AND DISCONNECT

(71) Applicant: Schlumberger Technology Corporation, Sugar Land, TX (US)

(72) Inventor: Gary L. Rytlewski, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/901,677

(22) PCT Filed: Jun. 27, 2014

(86) PCT No.: PCT/US2014/044534
§ 371 (c)(1),
(2) Date: Dec. 28, 2015

(87) PCT Pub. No.: WO2014/210435
PCT Pub. Date: Dec. 31, 2014

(65) Prior Publication Data

US 2016/0138355 A1 May 19, 2016

Related U.S. Application Data

(60) Provisional application No. 61/840,611, filed on Jun. 28, 2013.

(51) Int. Cl.
*E21B 41/04* (2006.01)
*E21B 33/038* (2006.01)
(Continued)

(52) U.S. Cl.
CPC ..... *E21B 33/0355* (2013.01); *E21B 33/038* (2013.01); *E21B 33/064* (2013.01); *E21B 34/045* (2013.01); *E21B 41/04* (2013.01)

(58) Field of Classification Search
None
See application file for complete search history.

(56) References Cited

U.S. PATENT DOCUMENTS 3,967,647 A 7/1976 Young
5,343,955 A 9/1994 Williams
(Continued)

FOREIGN PATENT DOCUMENTS

WO 2009018020 A1 2/2009

OTHER PUBLICATIONS

International Search Report and written opinion issued in the related PCT application PCT/US2014/044534 dated Oct. 27, 2014 (15 pages).

(Continued)

*Primary Examiner* — Matthew R Buck
*Assistant Examiner* — Douglas S Wood

(57) ABSTRACT

A technique facilitates automatic shut-in of a well and disconnect of a corresponding landing string. The landing string is employed in a well application and comprises a landing string module which measures a parameter or a variety of parameters. Those parameters may be used to determine the occurrence of an event which initiates shut-in of the well and disconnect of the landing string. The subsea landing string system is constructed to enable autonomous shut-in and disconnect.

19 Claims, 3 Drawing Sheets

(51) Int. Cl.

| | |
|---|---|
| ***E21B 33/064*** | (2006.01) |
| ***E21B 33/035*** | (2006.01) |
| ***E21B 34/04*** | (2006.01) |

(56) References Cited

U.S. PATENT DOCUMENTS

| | | | | |
|---|---|---|---|---|
| 6,293,344 | B1 * | 9/2001 | Nixon | E21B 34/045 166/363 |
| 6,725,924 | B2 * | 4/2004 | Davidson | E21B 33/0355 166/250.01 |
| 7,240,734 | B2 * | 7/2007 | Nivens | E21B 34/12 166/339 |
| 9,650,870 | B2 * | 5/2017 | Jenkins | E21B 17/017 |
| 10,066,458 | B2 * | 9/2018 | Deacon | E21B 34/02 |
| 2011/0120722 | A1 | 5/2011 | Scranton et al. | |
| 2013/0093179 | A1 * | 4/2013 | Jenkins | E21B 17/017 285/1 |
| 2013/0153242 | A1 | 6/2013 | Flight et al. | |
| 2014/0190703 | A1 * | 7/2014 | Tennant | E21B 17/04 166/365 |
| 2014/0311749 | A1 * | 10/2014 | Kongshem | E21B 17/01 166/364 |

OTHER PUBLICATIONS

International Preliminary Report on Patentability issued in the related PCT application PCT/US2014/044534 dated Dec. 29, 2015 (11 pages).

Search Report issued in the related EP Application 14817944.3 dated Jan. 24, 2017 (3 pages).

Communication Article 94-3 issued in the related EP Application 14817944.3 dated Mar. 29, 2017 (5 pages).

Office action issued in Azerbaijan Patent Appl. No. a2015 3072 dated Jun. 29, 2017; 5 pages (with English machine translation).

* cited by examiner

SUBSEA LANDING STRING WITH AUTONOMOUS EMERGENCY SHUT-IN AND DISCONNECT

CROSS-REFERENCE TO RELATED APPLICATION

The present document is based on and claims priority to U.S. Provisional Application Ser. No. 61/840,611 filed Jun. 28, 2013, incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed to control and enhance the efficiency of producing the various fluids from the reservoir. In subsea applications, various types of landing strings are deployed through subsea equipment, e.g. through a wellhead, a blowout preventer (BOP), and/or a riser. Upon the occurrence of certain events, the well is sometimes shut-in and the landing string is disconnected.

SUMMARY

In general, a system and methodology are provided which utilize a landing string in well applications, e.g. subsea well applications. The landing string comprises a landing string module which measures a variety of parameters. Those parameters may be used to determine the occurrence of a predetermined condition which initiates shut-in of the well and disconnect of the landing string. The subsea landing string system is constructed to enable autonomous shut-in and disconnect.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology that may be utilized in a variety of applications, including subsea applications. The system and methodology enable autonomous, emergency shut-in of a well and disconnect of a landing string upon the occurrence of certain events in well applications. The landing string comprises a separation component, e.g. a latch assembly, and a landing string module which measures a parameter or a variety of parameters. Those parameters may be used to determine the occurrence of the event which initiates autonomous shut-in of the well and disconnect of the landing string. The subsea landing string system is disconnected, e.g. split, and the well is closed at, for example, a BOP stack on the wellhead.

Embodiments described herein may take various forms of a subsea landing string system for autonomous shut-in and disconnect. Depending on the application, the system also comprises various landing string instrumentation modules. The landing string instrumentation module is incorporated into the landing string for measuring a variety of desired parameters which may be indicative of an event leading to shut-in of the well and disconnect of the landing string. Examples of measured parameters include tension, torque, pressure, temperature, and/or other parameters.

In various applications, embodiments are directed generally to limiting hydrocarbon release in an over pull emergency event due to, for example, drift off or lock up of the Active Heave-motion Drawworks (AHD). However, embodiments also may be directed to providing a landing string separation or fail point at a known location, e.g. a location below the shear rams of a blowout preventer. In some applications, a latch mandrel may be used as a shear sub constructed to undergo tensile failure prior to tensile failure of the remainder of the landing string, e.g. 20% sooner than failure of the remainder of the landing string. In other words, the latch mandrel provides a landing string weak link. Various embodiments also may be used during flow back operations.

Figure 1:
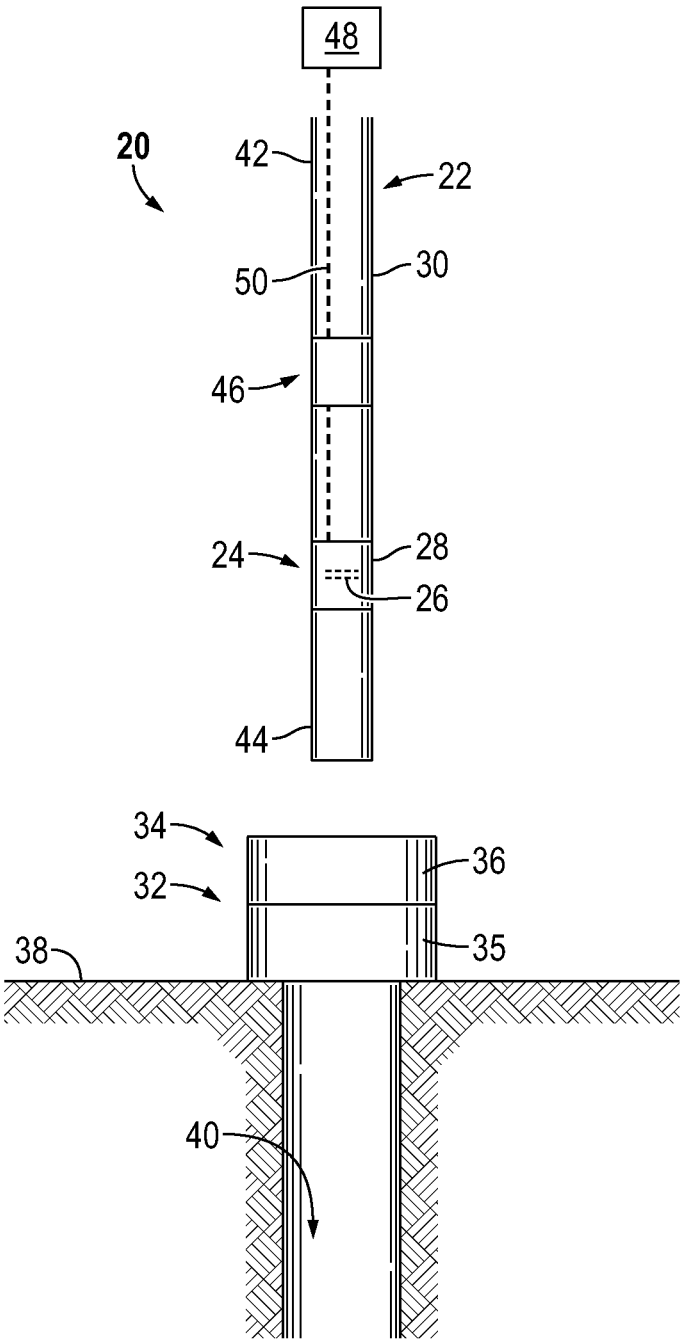
FIG. 1 is a schematic illustration of an example of a subsea well system having a landing string position for deployment through subsea equipment located at a seabed, according to an embodiment of the disclosure.

Referring generally to FIG. 1, an embodiment of a well system 20 is illustrated. In this embodiment, well system 20 comprises a landing string 22 having a latch assembly 24. The landing string 22 may be a subsea landing string for use in offshore well applications. In various applications, the subsea landing string 22 enables completion testing, flow testing, intervention, and/or other subsea well operations to be performed from a floating vessel or other surface vessel or structure. Depending on the operation, the landing string 22 may comprise a variety of components, including mechanical barriers and a latch assembly 24 to enable autonomous disconnection of the landing string 22 at latch assembly 24. In some applications, the latch assembly 24 may be constructed to enable subsequent re-engagement of the disconnected portions of the landing string 22.

The latch assembly 24 may have a variety of configurations able to facilitate the autonomous disconnect of the landing string 22 and the well shut-in. By way of example, latch assembly 24 comprises a latch mandrel having a weakened area 26. The weakened region 26 may be placed in a housing 28 which protects the latch assembly 24 against bending loads while still providing a breakpoint selectively favoring breaking/disconnection upon application of a predetermined vertical tensile load on the latch assembly 24. The weakened region 26 separates upon application of the predetermined tensile load. By way of example, the predetermined tensile load may be applied by providing a sufficient vertical lifting force on landing string 22 from the surface, however the tensile load also may be applied by hydraulic pistons or other mechanisms. Additionally, the latch assembly 24 may comprise a release mechanism, e.g. a collet or other releasable assembly, which enables a controlled disconnect of the landing string 22 at latch assembly 24. In this latter example, the controlled disconnect may be accomplished via a suitable hydraulic actuator or other type of actuator constructed to enable selective separation of the release mechanism and thus release of an upper latch assembly portion from a lower latch assembly portion of latch assembly 24.

In the example illustrated, the landing string 22 comprises tubing 30 and is positioned for use in a well 32. For example, the landing string 22 may be received by subsea well equipment 34, such as a subsea wellhead 35 which may be comprise or may be coupled with a blowout preventer (BOP) 36. The subsea wellhead 35 is located along a seafloor 38 above a wellbore 40. Depending on the application, the landing string 22 may comprise a variety of components including an upper landing string portion 42 and a lower landing string portion 44 coupled by the latch assembly 24. In this example, the landing string 22 further comprises a landing string instrumentation module 46 which detects parameters and initiates the autonomous disconnection of the landing string 22 at latch assembly 24 and the autonomous shut-in of well 32. However, the landing string 22 also may comprise many additional and/or other components, including valves, sliding sleeves, sensors, and/or other devices depending on the parameters of a given application.

The landing string instrumentation module 46 may communicate parameter data to a controller 48 via electromagnetic signals, e.g. electric signals, or other output signals sent through a communication line 50, such as an electrical line or optical fiber. However, the landing string instrumentation module 46 also may be constructed to communicate parameter data to controller 48 via other output signals, such as hydraulic or mechanical output signals. The communication line or lines 50 also may be used to communicate control signals and/or data signals to or from other landing string components. In some applications, the landing string instrumentation module 46 may be in communication with latch assembly 24 via suitable communication lines 50. For example, the latch assembly 24 can be constructed with other types of separation mechanisms which initiate disconnect of the landing string 22 upon receipt of the appropriate control signals from landing string instrumentation module 46 and/or controller 48.

Figure 2:
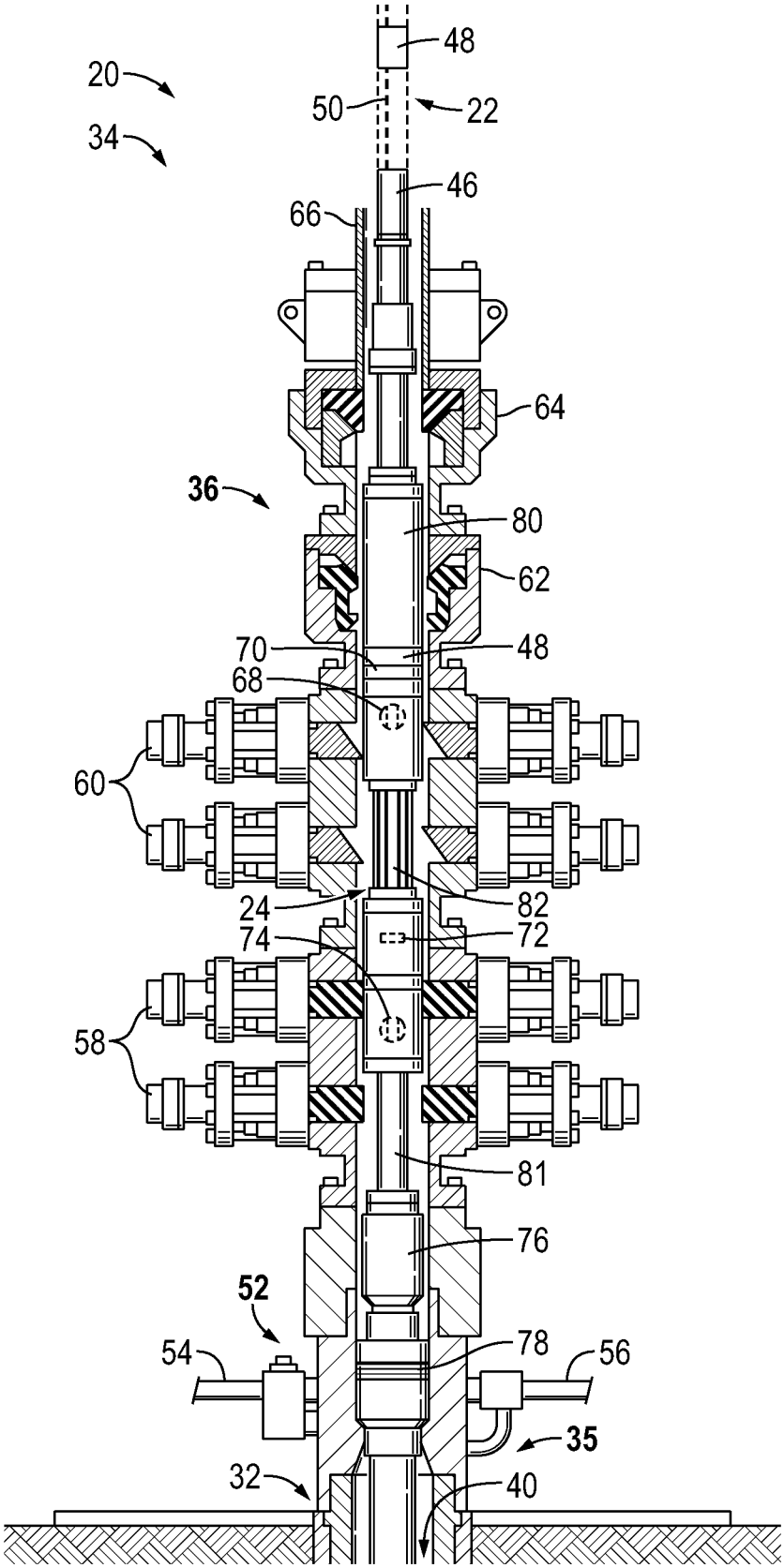
FIG. 2 is a cross-sectional view of an example of the subsea equipment through which a subsea landing string extends, according to an embodiment of the disclosure.

Referring generally to FIG. 2, a more detailed example of well system 20 is illustrated. In this example, subsea well equipment 34 comprises blowout preventer 36 mounted above wellhead 35 and above a tree 52, e.g. a horizontal tree, having a production line 54 and an annulus line 56. The blowout preventer 36 further comprises at least one pipe ram 58, e.g. a pair of pipe rams 58, and at least one shear ram 60, e.g. a pair of shear rams 60. In this example, the blowout preventer 36 further comprises a BOP disconnect 62 and an annular ram 64. In some applications, a riser 66 may extend upwardly from equipment 34, e.g. upwardly from blowout preventer 36.

As further illustrated in the embodiment of FIG. 2, the landing string 22 may comprise a variety of components. By way of example, the landing string 22 may comprise latch assembly 24 and landing string instrumentation module 46. Depending on the application, however, landing string 22 also may comprise a plurality of valves located above and below latch assembly 24. For example, the valves may comprise a retainer valve 68 and a bleed valve 70 located above the latch assembly 24. The valves also may comprise a flapper valve 72 and a ball valve 74 located below the latch assembly 24. However, other types of valves and other arrangements of valves also may be employed to selectively block or direct flow of fluid along an interior of the landing string 22.

In some applications, the landing string 22 also may comprise a tubing hanger and running tool assembly 76 and a seal assembly 78, e.g. a packer, located below latch assembly 24. The landing string 22 may further comprise a space out sub 80 positioned above the retainer valve 68 and bleed off valve 70 and a ported joint 81 positioned below ball valve 74. However, the landing string 22 may comprise a variety of other and/or additional components to accommodate the parameters of a given application. Similarly, the latch assembly 24 may comprise a variety of components and configurations. By way of example, the latch assembly 24 may comprise a shear sub or mandrel 82 which includes weakened region 26 to facilitate the autonomous disconnect of landing string 22 during, for example, an emergency shut-in of well 32.

In an operational example, the landing string instrumentation module 46 detects parameters, indicative of a predetermined condition, which trigger the autonomous disconnect of landing string 22 and the shut-in of well 32. Upon detection of the indicative parameters, an electronic signal (or other suitable signal) may be sent to the controller 48 to autonomously initiate the disconnect and shut-in procedure. For example, the controller 48 may include an electro-hydraulic control which controls actuation of latch assembly 24 and of valves which shut-in the well.

In some applications, the controller 48 causes the surface vessel or other surface equipment to automatically apply a tensile pulling/lifting force on landing string 22. For example, the latch assembly 24 may be actuated by controller 48 to a release position so that application of a tensile pulling force above a predetermined break level causes disconnection of the landing string 22 at latch assembly 24. In this example, the tensile pulling force causes weakened region 26 to break so that the upper landing string portion 42 may be moved away from the lower landing string portion 44. Once separation of the landing string 22 occurs, the portion of the landing string 22 above latch assembly 24 accelerates upwardly with recoil and gas thrust.

Based on additional signals from landing string instrumentation module 46 and/or mechanical actuation due to movement of the landing string 22, both the landing string 22 and the well 32 are closed or shut-in. For example, shut-in of the well 32 is automatically initiated by blocking upward flow of well fluid via closure of flapper valve 72 in a very short time period, e.g. approximately one second or less. Simultaneously, fluid is prevented from exiting the upper portion of landing string 22 by automatically closing retainer valve 68 in a short time period, e.g. approximately 6 seconds or less.

Figure 3:
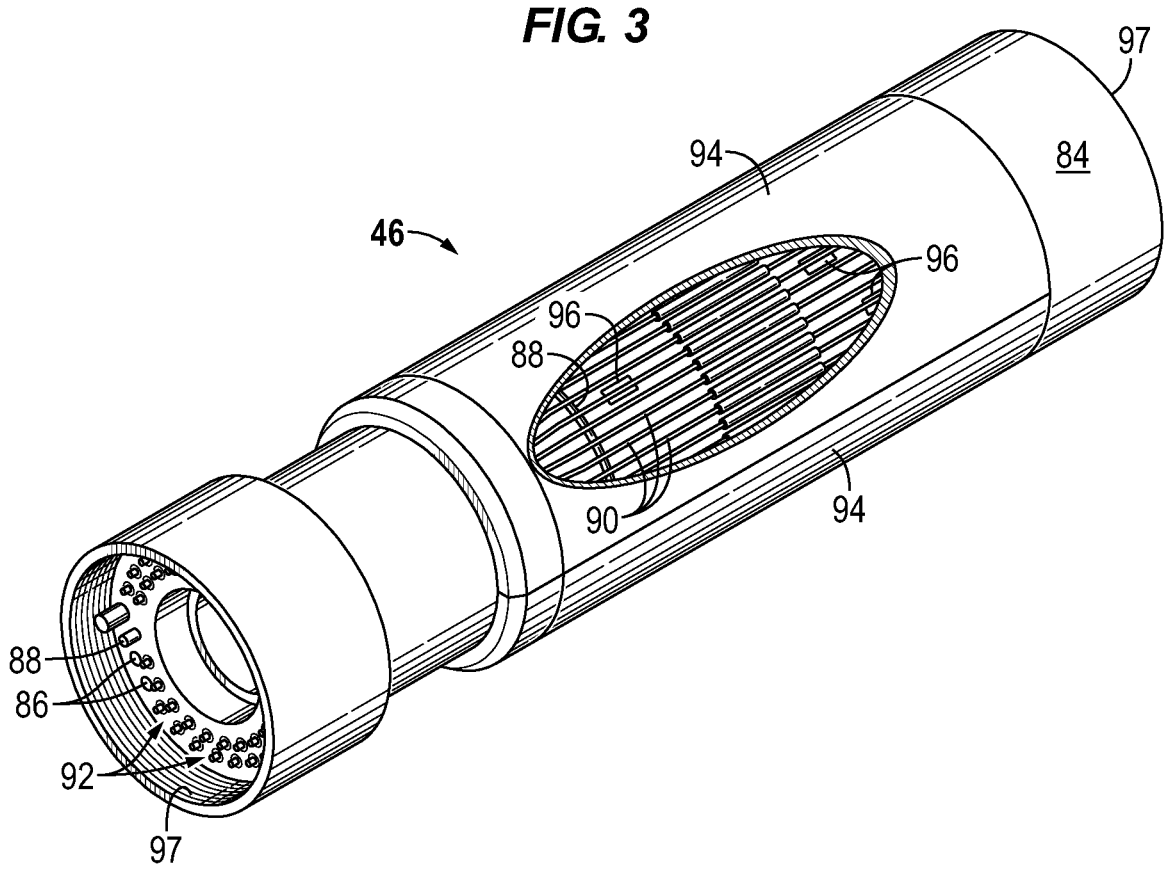
FIG. 3 is an orthogonal view of an example of a landing string instrumentation module which measures a variety of well related parameters, according to an embodiment of the disclosure.

Referring generally to FIG. 3, an embodiment of landing string instrumentation module 46 is illustrated. In this example, the landing string instrumentation module may be constructed to measure selected parameters of a variety of parameters, such as landing string tension, landing string torque, pressure, temperature, bending, inclination, orientation, and/or other parameters useful in determining whether to initiate the autonomous disconnect and shut-in.

By way of example, the landing string instrumentation module 46 comprises a housing 84 which may be constructed to carry the weight of the landing string below module 46 during deployment. The module 46 also may comprise a connector or a plurality of connectors 86 for coupling with communication line 50. In some applications, the landing string instrumentation module 46 comprises an additional external cable 88 and a plurality of hydraulic bypass tubes 90 coupled to hydraulic stabs 92. The cable 88 and bypass tubes 90 may be enclosed with a protective cover 94. Additionally, a plurality of sensors 96 is positioned along housing 84 and operatively coupled with communication line 50 via connectors 86. Examples of sensors 96 include strain gauges, pressure sensors, temperature sensors, gyro gauges, and/or other types of sensors 96 able to provide the desired data to controller 48 for initiation of the autonomous disconnect of landing string 22 and shut-in of well 32. The illustrated module 46 has connection ends 97, e.g. threaded connection ends, by which it is coupled into landing string 22 as a modular unit.

The landing string instrumentation module 46 may have its own controller, e.g. a local processor system. In the illustrated example, however, the module 46 works in cooperation with controller 48 which may include a processor-based controller located at the surface and/or at suitable subsea locations. The controller 48 also may incorporate a variety of deep water control systems and may comprise a single controller or a plurality of controllers. For example, controller 48 may comprise the SenTREE™ system which is a deep water control system, available from Schlumberger Corporation, for providing fast acting control of subsea test trees/landing strings.

By way of specific example, the controller 48 may further comprise an electro-hydraulic control system, such as the SenTURIAN™ system available from Schlumberger Corporation, which provides electro-hydraulic controls with fast response times and hydraulic power accumulation. This enables the SenTURIAN™ portion of controller 48 to control, for example, the SenTREE™ functionality, including closing of valves, e.g. closing of flapper valve 72 and retainer valve 68, as well as actuation of latch assembly 24 to disconnect landing string 22. In many applications, controller 48 is programmable so that the various control system related components, e.g. module 46, SenTURIAN™, and SenTREE™, respond automatically to specific parameters detected by module 46 so as to initiate and complete an autonomous emergency shutdown. If, for example, the sensors 96 of landing string instrumentation module 46 detect an over tension condition in the landing string 22, the module 46 provides data to controller 48 which autonomously initiates the disconnect of landing string 22 and the shut-in of well 32 via, for example, the deep water control and operating systems such as SenTREE™ and SenTURIAN™.

Figure 4:
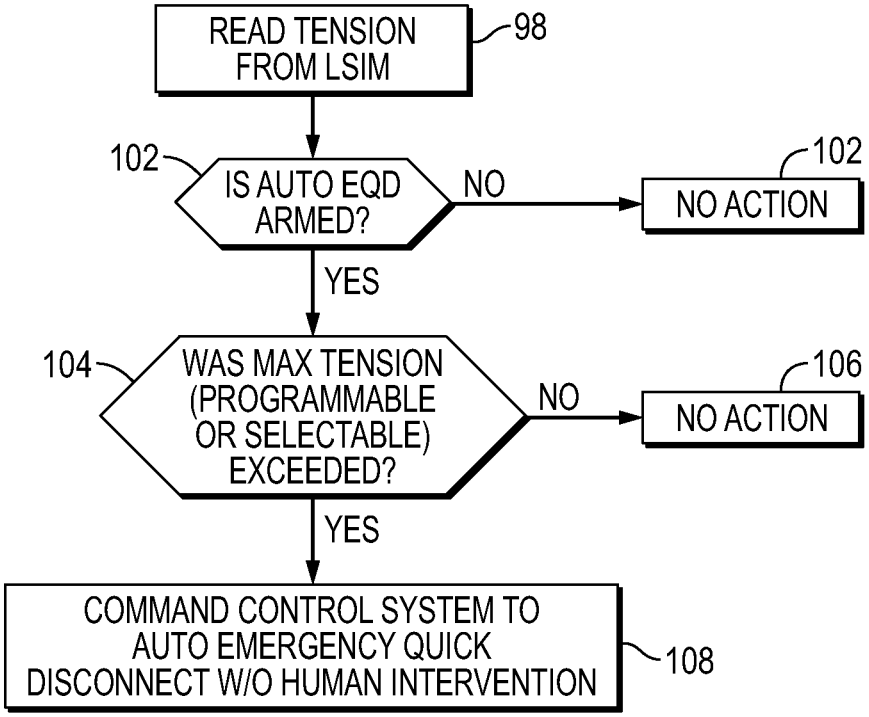
FIG. 4 is a flowchart illustrating an example of a logic sequence used in performing an autonomous quick disconnect and shut-in of a well, e.g. a subsea well, according to an embodiment of the disclosure.

Referring generally to FIG. 4, an operational example of the functionality of landing string instrumentation module 46 and controller 48 is illustrated in flowchart form. In this example, the sensors 96 of module 46 are used to detect tension in the landing string 22 and that tension data is provided to controller 48, as indicated by block 98. The controller 48 further queries whether the emergency quick disconnect (EQD) is armed, as indicated by block 100. If the EQD is not armed, no action is taken, as indicated by block 102. However, if the EQD is armed, the controller 48 determines whether the tension in landing string 22 is above a predetermined level, as indicated by block 104. It should be noted that the EQD may be a combination of the latch assembly 24 with a suitable electro-hydraulic control system, such as the SenTURIAN™ system referenced above. Depending on the configuration of latch assembly 24 and its release mechanisms/actuators, a suitable electrohydraulic control system can be used to cause the disconnection of the landing string 22 at latch assembly 24.

With additional reference to FIG. 4, if the predetermined maximum tension level is not exceeded, no action is taken, as indicated by block 106. In other words, the landing string 22 remains intact. However, if the maximum predetermined tension in landing string 22 is exceeded, controller 48 autonomously provides the appropriate commands and initiates the automatic disconnect of landing string 22 at latch assembly 24 and the shut-in of well 32, as indicated by block 108. For example, the controller 48 may initiate the automatic closing of flapper valve 72 and retainer valve 68 as well as the possible actuation of pipe rams 58 and shear rams 60.

In some applications, the module 46 and/or controller 48 may be programmable to operate in different modes. For example, during running in hole of the landing string 22, the landing string instrumentation module 46 may be in a position to carry completion string weight. During running in, the controller 48 may be set, e.g. programmed, to prevent unwanted disconnection at latch assembly 24 by maintaining latch assembly 24 in a locked position, e.g. by retaining a latch collet in a locked position. However, once the tubing hanger 76 is locked to the wellhead 35, the controller 48 may be set, e.g. programmed, to protect the system against over pulling (e.g. tensile loading above the maximum predetermined level) or against other unwanted conditions. In some applications, the controller 48 may be configured to enable the autonomous disconnect and shut-in functionality to be turned off temporarily. For example, the autonomous disconnect mode could be turned off during pulling out of hole.

Depending on the overall application, the landing string instrumentation module 46 may be used to provide data for other purposes. For example, data signals related to parameters other than tension may be used to trigger emergency shutdown or other actions via the subsea landing string electro-hydraulic operating system, e.g. SenTURIAN™. Module 46 may be operated to provide various signals for use in controlling a variety of completion hardware without the use of a separate umbilical for carrying the control signals. Examples of such signals include data signals related to torque, pressure pulses, changes in torque, changes in tension, and/or other data signals. Data signals related to over tension could still be used as a parameter for triggering the autonomous disconnect and shut-in.

Depending on the application, the well system 20 may be constructed in several configurations. For example, many types of wellhead and blowout preventer components may be used in a variety of subsea operations. Additionally, the landing string 22 may comprise a variety of latch assemblies, valves, hydraulic control actuators, completion components, landing features, tubing hangers, and/or other components selected according to the parameters of a given application. Similarly, controller 48 may be a combination of surface and subsea control systems and may comprise a variety of programmable components, e.g. programmable processors, and actuators. For example, controller 48 may comprise hydraulic control systems used to autonomously actuate valves, latch assemblies, and/or other components of the landing string, blowout preventer, and/or other subsurface equipment.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea well, comprising:

a blowout preventer;

a landing string received in the blowout preventer, the landing string comprising a plurality of valves, a selective disconnect latch assembly, and a landing string instrumentation module, the latch assembly in a housing that selectively favors breaking induced by a vertical load over breaking due to non-vertical bending loads, the housing accommodating a weakened region of tailored susceptibility to breaking when a predetermined vertical load is applied thereto; and a control system working in cooperation with the landing string instrumentation module to autonomously disconnect the landing string at the latch assembly and to block fluid flow above and below the latch assembly via closure of the plurality of valves upon the occurrence of a predetermined condition detected by the landing string instrumentation module.

2. The system as recited in claim 1, wherein the plurality of valves comprises a lower valve positioned along the landing string below the latch assembly and within the blowout preventer.

3. The system as recited in claim 2 wherein the lower valve comprises a flapper valve.

4. The system as recited in claim 2, wherein the plurality of valves comprises an upper valve positioned along the landing string above the latch assembly.

5. The system as recited in claim 4, wherein the upper valve comprises a retainer valve.

6. The system as recited in claim 1, wherein the predetermined condition comprises an over pull condition in which a tensile loading in the landing string exceeds a predetermined maximum value.

7. The system as recited in claim 2, wherein closure of the lower valve blocks upward flow of well fluid from the subsea well.

8. The system as recited in claim 1, wherein the control system is programmable.

9. The system as recited in claim 8, wherein the control system comprises an electro-hydraulic control system for actuating the latch assembly and the plurality of valves.

10. The system as recited in claim 1, wherein the landing string instrumentation module comprises a plurality of sensors arranged to detect the predetermined condition.

11. The system as recited in claim 10, wherein the plurality of sensors comprises a strain gauge to detect an over pull condition.

12. A system for use in a well, comprising:

a landing string instrumentation module positioned in a landing string as a weight supporting modular unit;

a selective disconnect latch assembly positioned in a housing of the landing string that selectively favors breaking induced by a vertical load over breaking due to non-vertical bending loads, the housing comprising a latch mandrel having a weakened region of tailored susceptibility to breaking when a predetermined vertical load is applied thereto; and a control system working in cooperation with the landing string instrumentation module to autonomously disconnect the landing string at the latch assembly and to block fluid flow above and below the latch assembly upon the occurrence of a predetermined condition detected by the landing string instrumentation module.

13. The system as recited in claim 12, wherein the landing string instrumentation module comprises a plurality of sensors.

14. The system as recited in claim 13, wherein the plurality of sensors comprises sensors arranged to measure tensile loading along the landing string.

15. The system as recited in claim 12, wherein the latch assembly comprises a weakened region which splits to disconnect an upper landing string portion from a lower landing string portion.

16. The system as recited in claim 12, wherein the well is automatically shut-in at least in part via autonomous closure of a plurality of valves positioned along the landing string.

17. The system as recited in claim 12, wherein the autonomous closure of the plurality of valves comprises closing at least one valve located above the latch assembly and at least one valve located below the latch assembly.

18. A method, comprising:

providing a landing string instrumentation module with a plurality of sensors;

coupling the landing string instrumentation module into a landing string with a selective disconnect latch assembly within a housing that selectively favors breaking induced by a vertical load over breaking due to non-vertical bending loads;

conveying the landing string to a subsea location and through a blowout preventer located above a wellbore and proximate a subsea floor;

using the landing string instrumentation module to monitor vertical load in the landing string above a predetermined level;

upon detection of the vertical load above the predetermined level, outputting an output signal from the landing string instrumentation module to a control system;

operating the control system to autonomously disconnect the landing string at a weakened region within the housing of tailored susceptibility to the vertical breaking and to shut-in the wellbore; and closing a retainer valve in the landing string in response to at least one signal from the landing string instrumentation module.

19. The method as recited in claim 18 wherein operating comprises disconnecting an upper portion of the landing string from a lower portion of the landing string at a latch assembly.

* * * * *